US005713217A

United States Patent [19]

Baba

[11] Patent Number: 5,713,217

[45] Date of Patent: Feb. 3, 1998

[54] REFRIGERANT CONDENSER WITH INTEGRAL RECEIVER

[75] Inventor: Norimasa Baba, Nagoya, Japan

[73] Assignee: Nippondenso Co., LTD., Japan

[21] Appl. No.: 538,801

[22] Filed: Oct. 3, 1995

[30] Foreign Application Priority Data

Oct. 6, 1994 [JP] Japan ..... 6-242586

[51] Int. Cl.[6] ..... F25B 39/04

[52] U.S. Cl. ..... 62/509; 62/298; 165/132; 165/76

[58] Field of Search ..... 62/509, 474, 298; 165/132, 76, 78, 138

[56] References Cited

U.S. PATENT DOCUMENTS

| | | | |
|---|---|---|---|
| 5,088,294 | 2/1992 | Ando . | |
| 5,159,821 | 11/1992 | Nakamura | 62/509 |
| 5,419,141 | 5/1995 | Burk | 62/509 |
| 5,592,830 | 1/1997 | Baba . | |
| 5,628,206 | 5/1997 | Baba . | |

FOREIGN PATENT DOCUMENTS 4320771 11/1992 Japan .

*Primary Examiner*—John M. Sollecito

*Attorney, Agent, or Firm*—Cushman Darby & Cushman; Intellectual Property Group of Pillsbury Madison & Sutro, LLP

[57] ABSTRACT

A second header pipe forming a second header of a refrigerant condenser and a receiver are joined by brazing. In a portion where the second header pipe and receiver are communicated, four ribs provided at a perimeter of a communication hole of the second header pipe are inserted within a communication hole of the receiver, and thereafter ribs are bent in an outer direction of the hole, and the second header and the receiver are provisionally joined at the communication-hole portion prior to brazing. Additionally, after a projection provided on an upper-side cap of the receiver has been inserted into an insertion hole provided in the second header pipe, an end portion thereof is widened outwardly, and the second header pipe and receiver are provisionally joined prior to brazing. In this way, both ends of the receiver are provisionally joined to the second header pipe prior to brazing, and so the second header and the receiver do not slip during brazing.

8 Claims, 4 Drawing Sheets

REFRIGERANT CONDENSER WITH INTEGRAL RECEIVER

CROSS REFERENCE TO RELATED APPLICATION

This application is based upon and claims priority from Japanese Patent Application No. 6-242586 filed Oct. 6, 1994, the contents of which are incorporated herein by reference.

BACKGROUND OF THE INVENTION

1. Field of the Invention

The present invention relates to a refrigerant condenser with integral receiver which integrally disposes a condenser to liquefy and compress refrigerant and a receiver to collect liquefied refrigerant, and a method for fabricating the same.

2. Description of the Related Art

Japanese Patent Application Laid-open No. 4-320771 is known as a refrigerant condenser with integral receiver which integrally disposes a condenser and receiver. The technique forming a flat portion of a side surface of a header of a refrigerant condenser together with forming a flat portion also on a header of a receiver and performing integral brazing with the two flat portions in an aligned state to cause to a refrigerant condenser with integral receiver to be compact is disclosed in the Patent application Laid-open.

During integral brazing of the refrigerant condenser and receiver, the header and receiver are integrally brazed by a furnace in a state of being provisionally retained by a jigs of wire on the like, but provisional retaining force of the header and receiver declined in the furnace due to change in thickness of respective members due to melting of brazing material, change in hardness of the respective members, and so on, and the joining surfaces of the header and receiver were susceptible to slippage, and an occurrence rate of joining defects due to slippage was high.

Additionally, one technique (this is not prior art.) was devised to prevent slippage of the header and receiver with an engagement portion of a communication hole by providing a communication hole in a receiver-contacting surface of the header, along with providing a communication hole in a header-contacting surface of the receiver to be communicated with the communication hole of the header and providing in one communication hole a rib to engage the interior of the other communication hole. However, in this devised technique as well, there existed the problem where, as shown in FIG. 6, joining surfaces of a header 101 and receiver 102 rotated and slipped during brazing, centering on an engagement member A in a communication hole, and a joining defect occurred.

SUMMARY OF THE INVENTION

In light of the circumstances described above, it is an object of the present invention to provide a refrigerant condenser with integral receiver which inhibits slippage of joining surfaces of a header and receiver during brazing, and which can prevent occurrence of a joining defect, and a method of fabrication thereof.

In one preferred mode of the present invention, a refrigerant condenser with integral receiver includes a refrigerant condenser and a receiver. The refrigerant condenser has a plurality of tubes where refrigerant flows internally, and a header joined at one end to the plurality of tubes where refrigerant flows internally. The receiver is supplied with condensed refrigerant which has passed through at least one of the plurality of tubes. The header and the receiver are joined. The receiver is composed of a receiving pipe which is opened at one end, and at least one cap which blocks the one end of the receiving pipe. The cap has a first engagement portion. The header has a second engagement portion for engaging with the first engagement portion.

Preferably, the receiving pipe is opened at both ends, the both ends are blocked with two caps.

Preferably, the receiving pipe has a bottom portion and is opened at one end.

Preferably, the receiver has a third engagement portion, the header has a fourth engagement portion for engaging with the third engaging portion.

Preferably, the header has a first joining surface which is a flat surface. The receiver has a second joining surface which is a flat surface. The first surface and the second surface are joined together. The first and third engagement portions are disposed on the first joining surface. The second and fourth engagement portions are disposed on the second joining surface.

Preferably, the first engagement portion is a projection for protruding outward. The second engagement portion is an insertion hole for engaging with the projection. The third engagement portion is a first hole. The fourth engagement portion is a second hole with ribs for protruding outward. The first hole and the second hole are opposed and joined by the ribs so that refrigerant flows in and out between the header and the receiver.

By causing a first engagement portion provided on a cap of a receiver to be engaged with a second engagement portion provided on a header, slippage of the header and receiver during brazing is prevented at the first and second engagement portions.

Because slippage of a header and receiver during brazing is inhibited at a first and second engagement portions, a joining defect of the header and receiver can be prevented. Additionally, because occurrence of a refrigerant condenser with integral receiver having a joining defect where a header and receiver have slipped is suppressed, unit production cost of the refrigerant condenser with integral receiver can resultantly be suppressed to a low level.

DETAILED DESCRIPTION OF THE PREFERRED EMBODIMENT

Figure 1:
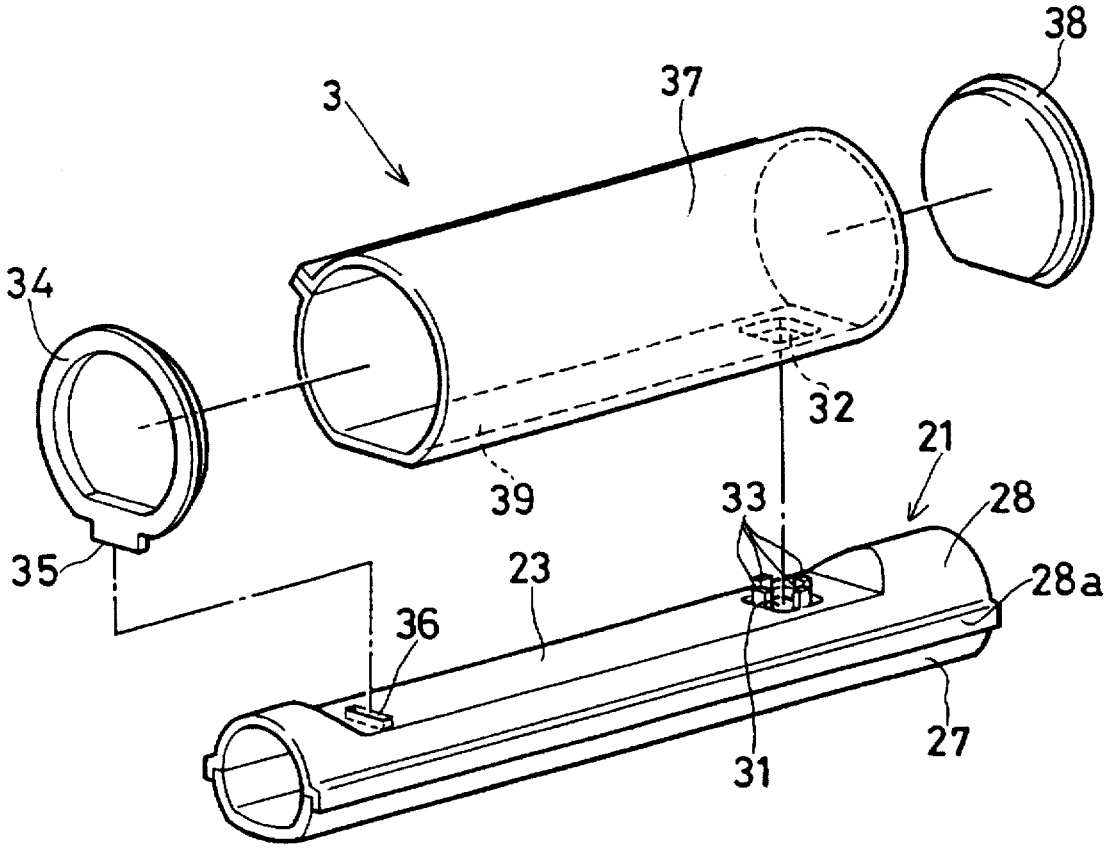
FIG. 1 is an exploded perspective view of a main part of a refrigerant condenser with integral receiver.

Next, a refrigerant condenser with integral receiver and method for fabricating the same according to the present invention will be described with reference to an embodiment indicated in the drawings.

(Embodiment Structure)

Figure 2:
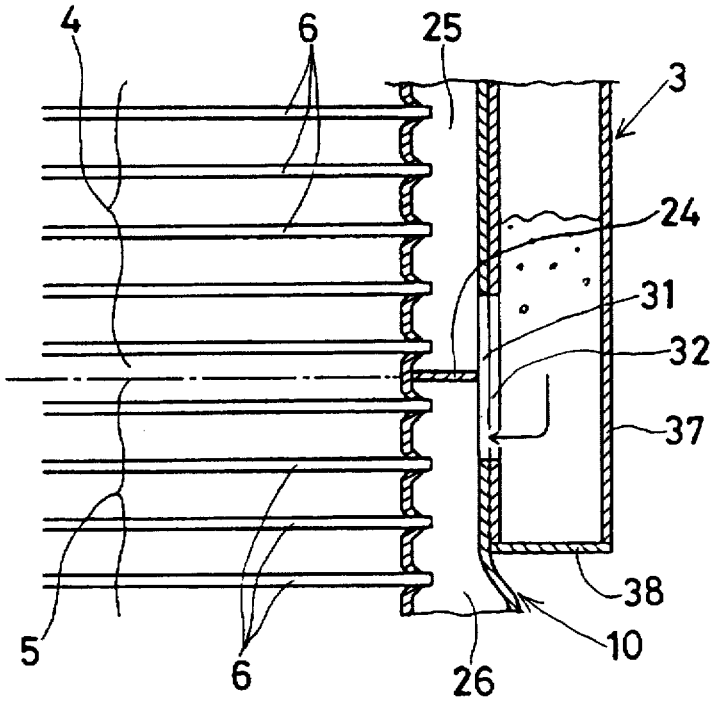
FIG. 2 is a sectional view of a part of the refrigerant condenser with integral receiver indicating flow of refrigerant of the condenser and receiver.
Figure 3:
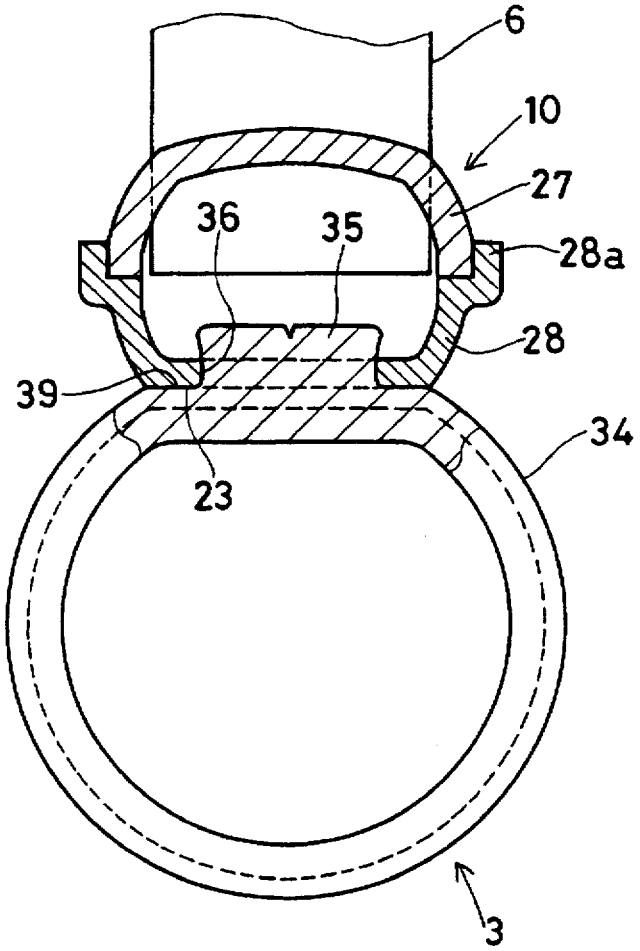
FIG. 3 is a sectional view of the refrigerant condenser with integral receiver indicating an engaged state of a projection and insertion hole.
Figure 4:
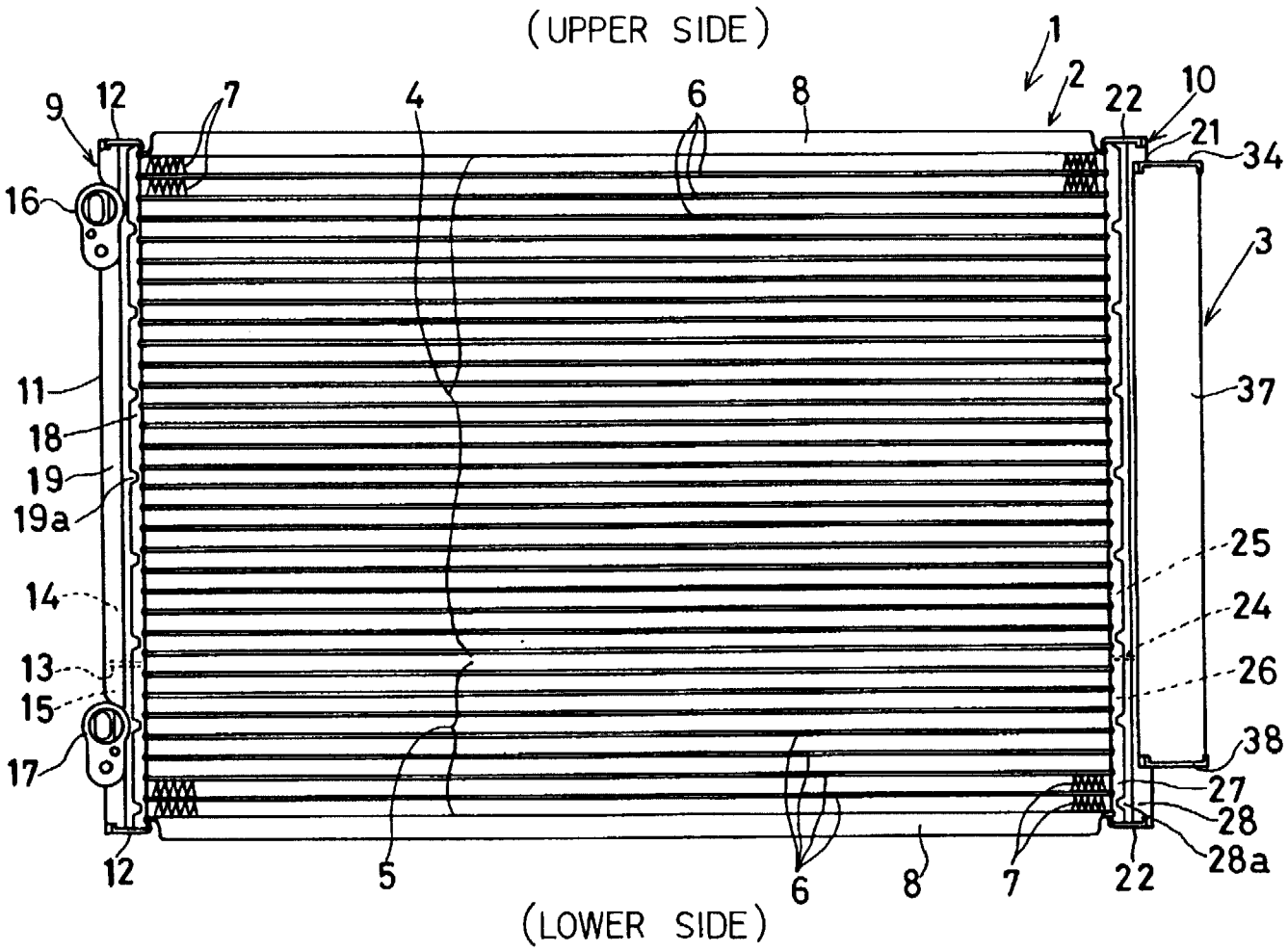
FIG. 4 is a front view of the refrigerant condenser with integral receiver.

FIGS. 1 through 5 indicate an embodiment according to the present invention; FIG. 4 is a front view of a refrigerant condenser with integral receiver.

A refrigerant condenser with integral receiver 1 is a structural component of a refrigeration cycle making up for example an automotive air-conditioning apparatus, and is installed in a location where wind generated by vehicle-moving passes, such as a front portion of a vehicle. This refrigerant condenser with integral receiver 1 is for example of all-aluminum fabrication, and is provided with an integrally brazed refrigerant condenser 2 and receiver 3. The refrigerant condenser 2 according to the present embodiment is provided with a condenser part 4 which causes high-temperature gas-phase refrigerant supplied from a refrigerant compressor (not illustrated) to exchange heat with air to be liquefied and be condensed, and a supercooling part 5 which causes refrigerant to further exchange heat with air and be supercooled under this condenser part 4.

The refrigerant condenser 2 is formed from laminated laminate bodies. The laminate bodies are formed by alternatingly laminating a plurality of tubes 6 and corrugated fins 7. The laminated laminate bodies are sandwiched from both sides by side plates 8, and a first header 9 and second header 10 are joined at both ends of the respective tubes 6.

The tubes 6 are formed by extruding, and a plurality of fluid passages (not illustrated) through which fluid passes are formed internally.

The corrugated fins 7 are roll-formed articles of thin, band-shaped plates machined into a wave configuration, and louvers (not illustrated) to heighten heat-exchange efficiency are formed on portions of both surfaces where air flows.

The side plates 8 are respectively joined to the first and second headers 9 and 10 on both sides, maintaining the strength of the refrigerant condenser 2 at a high level as well as preventing swelling of the tubes 6 due to internal pressure and deformation in the direction of lamination of the refrigerant condenser 2, and so a cross section presents a substantially u-shaped configuration.

The first header 9 (left-hand side of the drawing) is a container of substantially tubular configuration having a first header pipe 11 of tubular configuration and a first cap 12 which blocks both ends of this first header pipe 11, and an interior of this first header 9 is partitioned by a first separator 13 into a first upper-side chamber 14 which distributes refrigerant to the several tubes 6 of the condenser part 4, and a first lower-side chamber 15 which collects supercooled refrigerant which has passed through the several tubes 6 of the supercooling part 5.

Additionally, an inlet connecting portion 16 which inducts refrigerant discharged by a refrigerant compressor to within the first upper-side chamber 14, and along with this, an outlet connecting portion 16 which inducts liquid-phase refrigerant which has passed through the several tubes 6 of the supercooling part 5 and collected within the first lower-side chamber 15 to an external portion (pressure-reducing expansion means of refrigerant→refrigerant evaporator→refrigerant compressor), are joined to this first header 9.

Furthermore, the first header pipe 11 forming the first header 9 are formed by joining a first header plate 18 and a first tank plate 19. The first header plate 18 has approximately C-shaped cross-section in which the tubes 6 are inserted, and the first tank plate 19 has approximately C-shaped cross-section to which the inlet connecting portion 16 and outlet connecting portion 17 are joined.

The second header 10 (right-hand side of the drawing) is a container of substantially tubular configuration having a second header pipe 21 of tubular configuration and a second cap 22 (identical with the first cap 12) which blocks both ends of this second header pipe 21, and, as shown in FIG. 1, a header-side joining surface 23 to which the receiver 3 is joined is provided on an outer-side surface of this second header 10. An interior of this second header 10 is partitioned by a second separator 24 into a second upper-side chamber 25 which collects supercooled refrigerant which has passed through the several tubes 6 of the condenser part 4, and a second lower-side chamber 26 which distributes refrigerant to the several tubes 6 of the supercooling part 5.

The second header pipe 21 forming the second header 10 joins and is formed by joining a second header plate 27 (identical with the first header plate 18) of approximately C-shaped cross-section in which the tubes 6 are inserted, and a second tank plate 28 of approximately C-shaped cross-section where the header-side joining surface 23 to which the receiver 3 is joined is formed as a flat surface as shown in FIG. 1.

As shown in FIG. 1 and FIG. 2, a header-side communication hole 31 which inducts refrigerant of the second upper-side chamber 25 to within the receiver 3 as well as inducting refrigerant within the receiver 3 to the second lower-side chamber 26 is formed in a lower side of the header-side joining surface 23 of the second tank plate 28. This header side communication hole 31 is communicated with a receiver-side communication hole 32 which will be described later, and, as shown in FIG. 1, a plurality (according to the present embodiment, four) of ribs 33 (retaining tabs and protruding perpendicularly) inserted within a perimeter of the receiver-side communication hole 32 are formed in a perimeter of the header-side communication hole 31. This plurality of ribs 33 are to bend end portions to an outer side after being inserted within the receiver-side communication hole 32, provisionally joining the second header 10 and receiver 3 at the communication-hole portion.

Additionally, as shown in FIG. 1 and FIG. 3, an insertion hole 36 (corresponding to the second engagement portion) into which a projection 35 (corresponding to the first engagement portion) provided on an upper-side cap 34 of the receiver 3 which will be described later is inserted to engage with the projection 35 is formed in an upper side of the header joining surface 23 of the second tank plate 28.

As shown in FIG. 1, a receiving pipe 37 of tubular configuration, and an upper-side cap 34 and lower-side cap 38 to block both ends of this receiving pipe 37 are joined to form the receiver 3. The receiving pipe 37 according to the present embodiment rounds a flat plate into a tubular configuration and joins both edges, and a side surface of the receiving pipe 37 is provided with a flat receiver-side joining surface 39 which matches the header-side surface 23 of the second header 10.

The receiver-side communication hole 32 which is communicated with the header-side communication hole 31 is formed on a lower side of this receiver-side joining surface 39. As was described above, this receiver-side communication hole 32 inducts refrigerant of the second upper-side chamber 25 to within the receiver 3, as well as inducting refrigerant within the receiver 3 to the second lower-side chamber 26. Additionally, the plurality of ribs 33 described above are inserted into an interior of the receiver-side communication hole 32, and thereafter bent to provisionally join the second header 10 and receiver 3 at the communication hole.

Among the upper-side and lower-side caps 34 and 38, the projection 35 inserted within the insertion hole 36 of the second header 10 is provided on the upper-side cap 34. An external configuration of this projection 35 matches the insertion hole 36 and is disposed so that the insertion hole 36 is blocked by inserting the projection 35 within the insertion hole 36. After the projection 35 has been inserted within the insertion hole 36, the second header 10 and receiver 3 are provisionally joined at the projection 35 and insertion hole 36 portion by punching a sharp tool into the projection 35 by a fixture from an inner side of the second header 10 and widening the projection to an outer side.

(Method of Fabrication for the Refrigerant Condenser with Integral Receiver 1)

A method of fabrication for the refrigerant condenser with integral receiver 1 will be described next.

The several parts (plurality of tubes 6, corrugated fins 7, side plates 8, first header 9 second header 10, and receiver 3) making up the refrigerant condenser with integral receiver 1 utilize a metal (for example aluminum alloy) of favorable corrosion resistance and thermo-electrical conductivity, and is fabricated by utilizing an article clad with brazing material on surfaces of the several parts except the tubes 6.

Concretely, the plurality of tubes 6 obtains the predetermined configuration by extrusion, and the other parts obtain the predetermined configuration by pressing metal of plate configuration.

In assembly, firstly, as shown in FIG. 1, the plurality of ribs 33 of the second tank plate 28 is inserted within the receiver-side communication hole 32 of the receiver 3 pipe, the end portions of the ribs are bent outwardly, and the second header pipe 21 and receiver 3 are caused to be provisionally joined at the communication hole 32.

Meanwhile, the upper-side cap 34 and lower-side cap 38 are installed on both ends of the receiver 3 pipe, and the projection 35 of the upper-side cap 34 is inserted within the insertion hole 36 of the second tank plate 28. Accordingly, a sharp tool is knocked at an end portion of the projection 35 inserted within the insertion hole 36, widening the projection 35 outwardly and causing the second header 10 and receiver 3 to be provisionally joined at the projection 35 and insertion hole 36 portion.

Separately from these, the corrugated fins 7 and tubes 6 are laminated alternatingly on one side plate 8, and finally the other side plate 8 is mounted. Next, both ends of the plurality of tubes 6 and both ends of the side plates 8 are inserted within respective insertion holes of the first header plate 18 and second header plate 27, and a laminate body is provisionally assembled. At this time, both side plates are squeezed by a fixture of wire or the like to maintain the configuration of the laminate body so that the configuration of the laminate body does not slip.

Next, the first separator 13 is arranged at a predetermined position of an inner side of the first header plate 18, and thereafter, an opening side of the first tank plate 19 is caused to overlap an opening side of the first header plate 18. Accordingly, a retaining tab 19*a* formed on an edge of the first tank plate 19 is crimped to an inner side, and the first header pipe 11 is provisionally joined to an end of the laminate body.

Additionally, the second separator 24 is arranged at a predetermined position on an inner side of the second header plate 27, and thereafter, an opening side of the second tank plate 28 is caused to overlap an opening side of the second header plate 27. Accordingly, a retaining tab 28*a* formed on an edge of the second tank plate 28 is crimped to an inner side, and the second header pipe 21 is provisionally joined to an end of the laminate body.

Next, the first cap 12 is fitted into both ends of the first header pipe 11, the second cap 22 is fitted into both ends of the second header pipe 21, and moreover the inlet connecting portion 16 and outlet connecting portion 17 are fitted into the first tank plate 19. Assembly of the refrigerant condenser with integral receiver 1 priorly to brazing is completed by the foregoing. Furthermore, the assembly procedure indicated in the present embodiment is an example, and modification of sequence as appropriate is possible.

Figure 5:
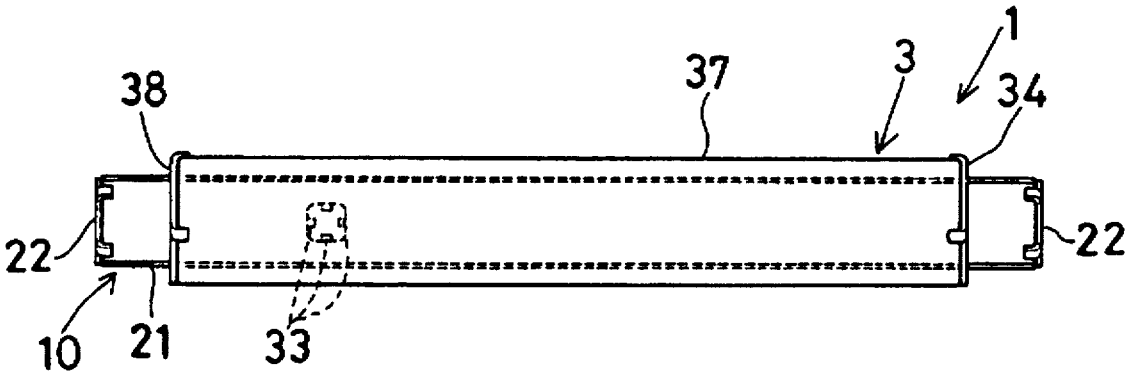
FIG. 5 is a top view indicating a disposed state of a refrigerant condenser with integral receiver in a furnace.
Figure 6:
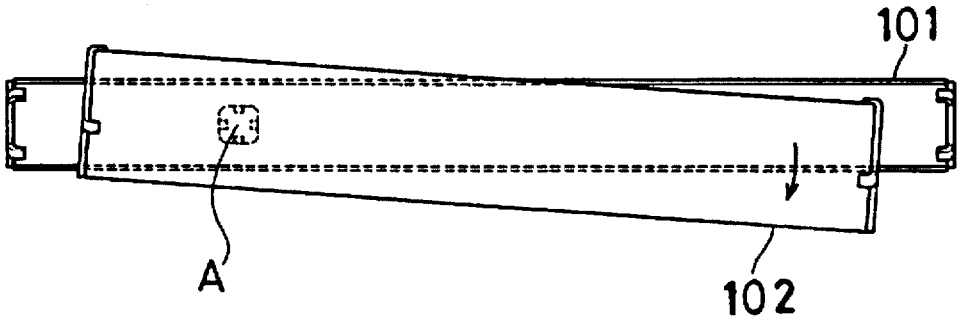
FIG. 6 is a top view of the condenser with integral receiver indicating a disposed state in the related art.

The refrigerant condenser with integral receiver 1 priorly to brazing which has been assembled as described above is plurally laminated vertically in a state where the first and second headers 9 and 10 and the receiver 3 are facing horizontally, as shown in FIG. 5. Accordingly, the refrigerant condenser with integral receiver 1 plurally laminated vertically priorly to brazing is placed for a predetermined time within a high-temperature furnace. Thereupon, the brazing material clad on the several parts flows around the joining portions of the respective parts. Accordingly, the refrigerant condenser with integral receiver 1 is extracted from the furnace and temperature is allowed to cool. Thereupon, the brazing material which has flowed around the joining portions hardens, and brazing joining is completed. The refrigerant condenser with integral receiver 1 indicated in FIG. 4 is completed by the foregoing.

(Operation of the Embodiment)

Operation of the foregoing embodiment will be described next.

When the automotive air-conditioning apparatus is started and an operation instruction is given to the refrigeration cycle, an electromagnetic clutch provided on the refrigerant compressor switches on, and rotational drive power of the engine is transmitted to the refrigerant compressor. Thereupon, the refrigerant compressor takes in, compresses, and thereafter discharges refrigerant. High-temperature, high-pressure gas-phase refrigerant discharged by the refrigerant compressor is supplied via refrigerant piping to the inlet connecting portion 16 of the refrigerant condenser with integral receiver 1.

The high-temperature, high-pressure gas-phase refrigerant supplied to the inlet connecting portion 16 is distributed from within the first upper-side chamber 14 to the tubes 6 which are linked within the first upper-side chamber 14, and passes within the tubes 6. The gas-phase refrigerant which passes within the tubes 6 usurps heat from air flowing between tubes 6 and tubes 6, and is condensed. Condensed vapor-liquid two-phase refrigerant flowing through the tubes 6 is collected by the second upper-side chamber 25, passes through the header-side communication hole 31 and receiver-side communication hole 32 of the upper side of the second separator 24, and is supplied to within the receiver 3.

The gas-liquid two-phase refrigerant supplied to within the receiver 3 is gas-liquid separated in the interior of the receiver 3, and liquid-phase refrigerant passes through the header-side communication hole 31 and receiver-side communication hole 32 of the lower side of the second separator 24, and is supplied to within the second lower-side chamber 26. The liquid-phase refrigerant supplied to the tubes 6 which are linked within the second lower-side chamber 26, and passes within the tubes 6. The liquid-phase refrigerant which passes within the tubes 6 usurps heat from air flowing between tubes 6 and tubes 6, and the liquid-phase refrigerant is supercooled. The supercooled liquid-phase refrigerant flowing through the tubes 6 is collected by the first lower-side chamber 15 and is inducted to the outlet connecting portion 17.

The liquid-phase refrigerant with a large degree of supercooling inducted to the outlet connecting portion 17 is inducted via refrigerant piping connected to the outlet connecting portion 17 to the pressure-reducing expansion means, pressure-reduced, and becomes low-temperature refrigerant of mist form. The low-temperature mist-form refrigerant is inducted to within the refrigerant evaporator, is evaporated by exchanging heat with air blown into a passenger compartment, and becomes gas-phase refrigerant. Furthermore, the air blown into the passenger compartment is robbed of vaporization heat when refrigerant evaporates and becomes low-humidity, low-temperature air, is blown within the passenger compartment, and dehumidifies and cools the interior of the passenger compartment. The gas-phase refrigerant which has passed through the refrigerant evaporator is again taken in to the refrigerant compressor via the refrigerant piping, and the above-described cycle is repeated.

(Effects of the Embodiment)

According to the present embodiment, during assembly priorly to brazing, the second header 10 and receiver 3 are provisionally joined at the communication-hole portion by bending the ribs 33 of the second header 10 outwardly after insertion into the receiver-side communication hole 32 of the receiver 3, and along with this, the second header 10 and receiver 3 are provisionally joined at the projection 35 and insertion hole 36 portion by inserting the projection 35 of the upper-side cap 34 of the receiver 3 within the insertion hole 36 of the second header 10 and bending the end portion of the projection 35 outwardly.

That is to say, both sides of the receiver 3 are respectively provisionally joined to the second header 10. For this reason, the receiver 3 and second header 10 are maintained in a contacting state when performing brazing with the furnace in a state where the first and second headers 9 and 10 and the receiver 3 are facing horizontally, even when a fixture of wire or the like to press the receiver-side joining surface 39 of the receiver 3 against the header-side joining surface 23 of the second header 10 is not employed.

As a result of this, there is no slippage of the receiver 3 and second header 10 during brazing due to gravity or the like, and occurrence of a refrigerant condenser with integral receiver 1 of defective joining is suppressed. For this reason, a correct refrigerant condenser with integral receiver 1 does not need to bear costs entailed by defective articles, and unit cost of the refrigerant condenser with integral receiver 1 can resultantly be suppressed to a low level.

Additionally, because the receiver 3 and second header 10 doe not slip during brazing, joining precision of the header and receiver 3 can be made to be high.

Furthermore, because the receiver 3 is provisionally joined to the second header 10 even without employing a fixture of wire or the like, a fixture to provisionally join the receiver 3 to the second header 10 becomes unnecessary, and an effect of eliminating cost entailed by a fixture and inconvenience of attaching and removing a fixture is also demonstrated.

(Modifications)

According to the foregoing embodiment, the receiving pipe 37 is a pipe with two open ends and caps 34 and 38 are used to close the two open ends. However, it may be used receiving pipe 37 with a bottom portion integrally formed by deep drawing.

Further, an embodiment which provided joining surfaces of the second header 10 and receiver 3 as flat surfaces was indicated, but it is also acceptable for example to provide one joining surface as a curved surface and provide the other joining surface so as to match the first joining surface.

According to the above-described embodiment, a first engagement portion (the projection 35 according to the embodiment) was provided only on the upper-side cap 34, but it is also acceptable to eliminate engagement of the ribs 33 of the header-side communication hole 31 and receiver-side communication hole 32, provide a first engagement portion (for example a projection 35) on the lower-side cap 38 as well, and provide second engagement portions (for example both being insertion holes 36) on the side surface of the second header 10 to engage the respective first engagement portions.

According to the above-described embodiment, an embodiment which inducts refrigerant from the second header 10 to the receiver 3 as well as inducting refrigerant within the receiver 3 to the second header 10 by a single communication hole composed of the header-side communication hole 31 and receiver-side communication hole 32 was indicated, but it is also acceptable to independently provide a communication hole to induct refrigerant from the second header 10 to the receiver 3 and a communication hole to induct refrigerant within the receiver 3 to the second header 10.

According to the above-described embodiment, an embodiment which provided the supercooling part 5 in the refrigerant condenser 2 was indicated, but it is also acceptable to eliminate the supercooling part 5 and provide so as to induct refrigerant which has passed through all tubes 6 to the receiver 3 and induct refrigerant within the receiver 3 to an external portion.

According to the above-described embodiment, an embodiment which was provided so that the projection 35 passed through the insertion hole 36 was indicated, but it is also acceptable to provide the insertion hole as a concave portion and insert the projection 35 within the concave portion to prevent slippage during brazing.

According to the above-described embodiment, engagement of the projection 35 and insertion hole 36 was indicated as an embodiment of a first engagement portion and second engagement portion, but it is also acceptable to employ another means for engaging, such as providing for example a first engagement portion of claw configuration to be mated with a concave portion of the cap 22 of the second header 10, making the claw to be a first engagement portion and the concave portion of the cap 22 to be a second engagement portion, and so on.

What is claimed is:

1. A refrigerant condenser with integral receiver, comprising:

a refrigerant condenser having a plurality of tubes where refrigerant flows internally, and a header joined at one end to said plurality of tubes where refrigerant flows internally, and a receiver supplied with condensed refrigerant which has passed through at least one of said plurality of tubes, said header and said receiver being joined, wherein:

said receiver is composed of a receiving pipe which is opened at one end and at least one cap which blocks said one end of said receiving pipe, said cap having a first engagement portion, said header having a second engagement portion for engaging with said first engagement portion, an axial length of the receiver being shorter than an axial length of the header, the second engagement portion being formed on a sidewall of the header, and each of the receiver and the header having a flat surface formed on a sidewall thereof, the receiver and the header being joined together at said flat surfaces, wherein said second engagement portion comprises a hole defined in said sidewall of the header.

2. A refrigerant condenser with integral receiver, according to claim 1, wherein said receiving pipe is opened at both ends, said both ends are blocked with two caps.

3. A refrigerant condenser with integral receiver, according to claim 1, wherein said receiving pipe has a bottom portion and is opened at one end.

4. A refrigerant condenser with integral receiver, according to claim 1, wherein said receiver has a third engagement portion, said header has a fourth engagement portion for engaging with said third engaging portion.

5. A refrigerant condenser with integral receiver, according to claim 4, wherein said header has a first joining surface, said receiver has a second joining surface, said first surface and said second surface are joined together, said first and third engagement portions are disposed on said first joining surface, said second and fourth engagement portions are disposed on said second joining surface.

6. A refrigerant condenser with integral receiver, comprising:

a refrigerant condenser having a plurality of tubes where refrigerant flows internally, and a header joined at one end to said plurality of tubes where refrigerant flows internally, and a receiver supplied with condensed refrigerant which has passed through at least one of said plurality of tubes, said header and said receiver being joined, wherein:

said receiver is composed of a receiving pipe which is opened at one end and at least one cap which blocks said one end of said receiving pipe, said cap having a first engagement portion, said header having a second engagement portion for engaging with said first engagement portion, wherein said receiver has a third engagement portion and said header has a fourth engagement portion for engaging with said third engaging portion, wherein said header has a first joining surface, said receiver has a second joining surface, said first joining surface and said second joining surface are joined together, said first and third engagement portions are disposed on said first joining surface, and said second and fourth engagement portions are disposed on said second joining surface, wherein said first engagement portion is a projection for protruding outward, said second engagement portion is an insertion hole for engaging with said projection, said third engagement portion is a first hole, said fourth engagement portion is a second hole with ribs for protruding outward, said first hole and said second hole are opposed and joined by said ribs, so that refrigerant flows in and out between said header and said receiver.

7. A refrigerant condenser with integral receiver according to claim 6, wherein said ribs makes said first hole and said second hole engage by crimping and said projection engages with said insertion hole by widening said projection by knocking.

8. A refrigerant condenser with integral receiver, according to claim 1, wherein said second engagement portion is formed on said flat surface of said header.

* * * * *